United States Patent [19]

Aonuma et al.

[11] 4,141,763

[45] Feb. 27, 1979

[54] PROCESS FOR PRODUCTION OF FERROMAGNETIC POWDER AND APPARATUS THEREFOR

[75] Inventors: Masashi Aonuma; Yasuo Tamai; Tatsuji Kitamoto; Fumio Kodama, all of Odawara, Japan

[73] Assignee: Fuji Photo Film Co., Ltd., Minami-ashigara, Japan

[21] Appl. No.: 784,747

[22] Filed: Apr. 5, 1977

Related U.S. Application Data

[63] Continuation-in-part of Ser. No. 519,713, abandoned.

[30] Foreign Application Priority Data

Oct. 31, 1973 [JP] Japan ..... 48/122541

[51] Int. Cl.[2] ..... H01F 1/06

[52] U.S. Cl. ..... 148/105; 75/0.5 AA; 75/108

[58] Field of Search ..... 148/105, 31.55, 108; 23/285; 75/0.5 AA, 109; 252/62.55

[56] References Cited

U.S. PATENT DOCUMENTS

| | | | |
|---|---|---|---|
| 3,206,338 | 9/1965 | Miller et al. | 148/105 |
| 3,669,643 | 6/1972 | Bagley et al. | 75/0.5 AA |
| 3,672,867 | 6/1972 | Little | 75/0.5 AA |
| 3,684,484 | 8/1972 | Marchese et al. | 75/0.5 AA |
| 3,782,706 | 1/1974 | Muhlpfordt | 75/109 |

*Primary Examiner*—W. Stallard

*Attorney, Agent, or Firm*—Sughrue, Rothwell, Mion, Zinn and Macpeak

[57] ABSTRACT

A process for producing a ferromagnetic powder comprising injecting a stream of an aqueous solution of a metal salt capable of forming a ferromagnetic substance and a stream of solution containing a reducing material for mixing into a reaction chamber such that the two solutions impinge upon one another causing an oxidation-reduction reaction between them to occur, and applying a magnetic field of 50 oe or more to the particles produced by the oxidation-reduction reaction for the period during which the particles become ferromagnetic particles after going through a superparamagnetic state and an apparatus for use in the practice of the above process comprising a reaction vessel, at least one nozzle for injecting each of a solution of a metal salt and a solution containing a reducing material into the reaction vessel and a magnet for producing a magnetic field in the reaction vessel with the nozzles being open to the magnetic field and positioned so that the solution of the metal salt and the solution of the reducing material when injected are mixed.

5 Claims, 1 Drawing Figure

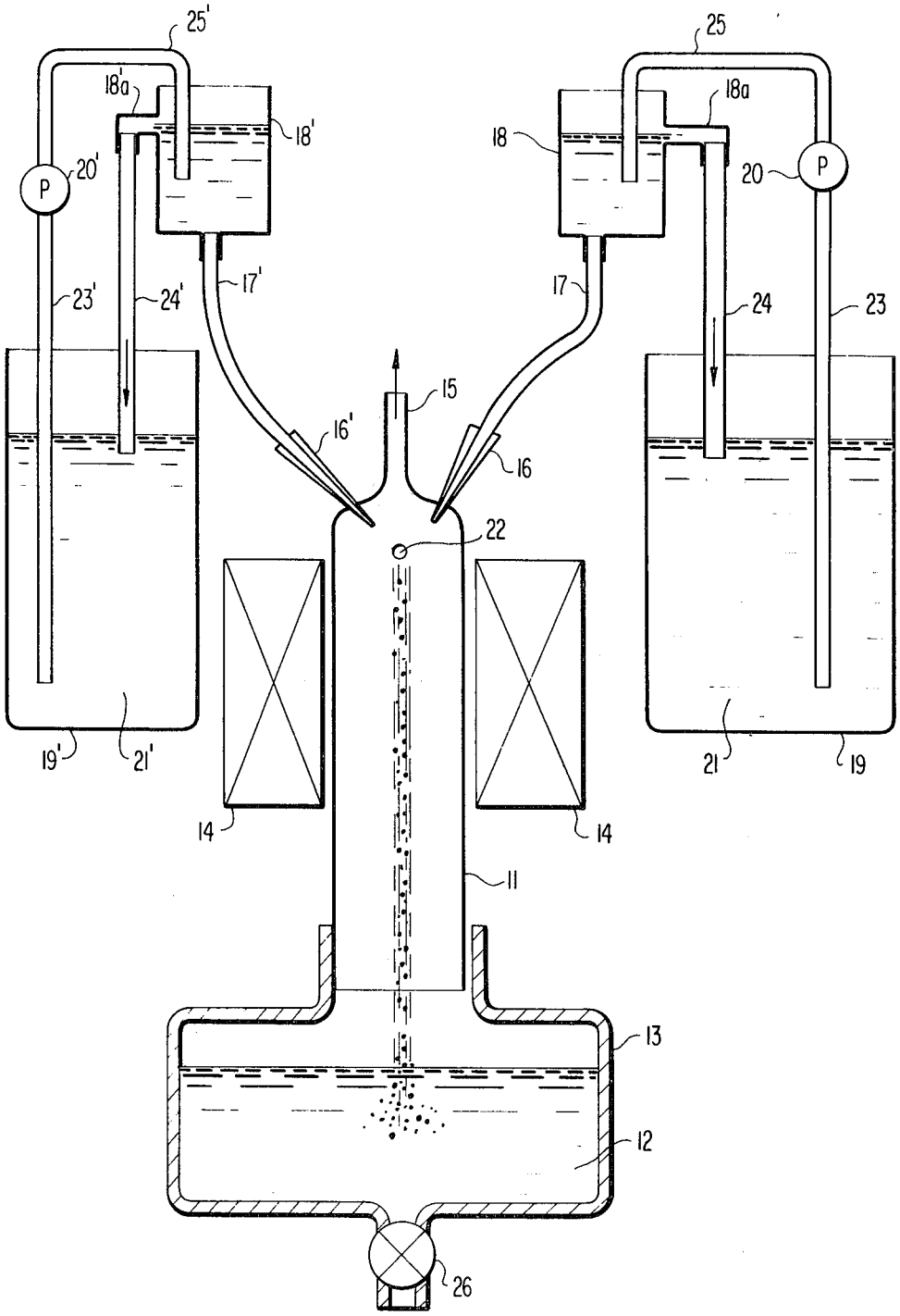
25'
25
18'a
18a
18'
18
20'
20
P
P
23'
24'
17'
17
24
23
15
16'
16
22
19'
21'
21
19
14
14
11
13
12
26

PROCESS FOR PRODUCTION OF FERROMAGNETIC POWDER AND APPARATUS THEREFOR

This is a continuation-in-part of application Ser. No. 519,713 filed Oct. 31, 1974 and now abandoned.

BACKGROUND OF THE INVENTION

1. Field of the Invention

The present invention relates to a process and an apparatus for the production of a ferromagnetic metal powder. More particularly, the present invention relates to a process for the continuous production of a ferromagnetic powder having excellent properties as a magnetic material for use in a magnetic recording medium, and an apparatus for use in the practice of the process.

2. Description of the Prior Art

Hitherto, $\gamma$-$Fe_2O_3$, Co containing $\gamma$-$Fe_2O_3$, $Fe_3O_4$, Co containing $Fe_3O_4$, $CrO_2$ and the like have been used as a ferromagnetic powder for a magnetic recording medium. These ferromagnetic powders, however, have not been suitable for use in magnetic recording wherein a signal of a short recording wave length (below about 10$\mu$) is used, i.e., the so-called high density recording, because the magnetic properties such as the coercive force (Hc), the maximum residual magnetic flux density (Br) and the like are insufficient. Recently, in order to solve the above described drawbacks of the hitherto used ferromagnetic powders, a ferromagnetic powder is being extensively developed which has properties suitable for high density recording. Thus, various ferromagnetic powders of metals or metal alloys have been investigated and proposed. In general, as ferromagnetic metals, iron, cobalt and nickel are mainly used and, if desired, chromium, manganese, rare earth elements, zinc or the like is added.

The following processes for the production of the ferromagnetic substances are known.

(1) A method comprising decomposing an organic acid salt of a ferromagnetic metal by heating, and reducing in a reducing atmosphere.

This method is described in, for example, Japanese Patent Publication Nos. 11412/1961, 22230/1961, 8027/1965, 14818/1966, 22394/1968, 38417/1972, and *The Record of Electrical and Communication Engineering Conversazione Tohoku University,* Vol. 33, No. 2, Page 57 (1964).

(2) A method comprising reducing a needle-like oxyhydroxide or other metal containing needle-like oxyhydroxides, or a needle-like iron oxide as produced from these needle-like oxyhydroxides.

This method is described in, for example, Japanese Patent Publication Nos. 3862/1970, 20939/1964, 39477/1972, German Patent Laid Open (OLS) No. 2,130,921, British Pat. No. 1,192,167, and U.S. Pat. No. 3,681,018.

(3) A method comprising vaporizing a ferromagnetic metal in an inert gas.

This method is described in, for example, Japanese Patent Publication No. 27718/1972, and *Oyo Butsuri* (*Applied Physics*), Vol. 40, No. 1, Page 110 (1971).

(4) A method comprising decomposing a metal carbonyl compound.

This method is described in, for example, U.S. Pat. Nos. 2,983,997, 3,172,776, 3,200,007, and 3,228,882.

(5) A method comprising electro-depositing a ferromagnetic iron using a mercury cathode and separating the mercury.

This method is described in, for example, Japanese Patent Publication Nos. 15525/1964, 8123/1965 and U.S. Pat. No. 3,156,650.

(6) A method comprising reducing a ferromagnetic metal salt in a solution thereof.

This method is described in, for example, Japanese Patent Publication Nos. 20520/1963, 26555/1963, 20116/1968, 41718/1972, U.S. Pat. Nos. 3,663,318, 3,661,556, German Patent Laid Open (OLS) Nos. 2,132,430, 2,326,258 and 2,326,261, and U.S. Pat. Nos. 3,206,338, 3,494,760, 3,567,525, 3,535,104, 3,607,218, 3,756,866, 3,669,643, 3,663,318, 3,772,867 and 3,790,407.

The present invention is concerned with an improvement in the Method (6) above wherein a ferromagnetic metal salt is reduced in a solution thereof, and particularly, the present invention is concerned with the use of a borohydride compound or derivative thereof as a reducing agent.

It is known that the oxidation-reduction reaction using borohydride or derivative thereof as a reducing agent is generally vigorous. For instance, when sodium borohydride is used as a reducing agent, a large volume of hydrogen gas is liberated simultaneously with the beginning of reaction, and thus the reaction solution is bubbled, the ferromagnetic powder produced rises to the upper portion of the reaction vessel together with the bubbles, the reaction volume is materially increased and the reaction solution often overflows. The phenomenon that the reaction volume is increased, often tends to take place particularly markedly where an additive, e.g., a surface active agent, an organic solvent, and the like is added to the reaction solution in order to improve the magnetic properties or to increase the stability of the magnetic substance to oxidation. As stated above, since the oxidation-reduction reaction is vigorous and the ferromagnetic powder produced is highly active, many difficulties have been encountered in the procedure. Furthermore, the reaction has been required to be carried out in a magnetic field in order to improve the magnetic properties of the ferromagnetic powder produced. In order to effect the reaction industrially while fulfilling the above requirements, various methods have been investigated from various standpoints, but these methods are not satisfactory with respect to economy, reaction stability and so on. Machese et al disclose a process in U.S. Pat. No. 3,684,484 wherein individual reactant fluids enter a mixing zone in a controlled laminar flow, the reactant fluids are merged in the mixing zone where finely divided metallic particles are produced by chemical oxidation-reduction. In one application Machese et al disclose the use of a magnetic field located downstream from the point at which the reactant streams merge. Little discloses a procedure for producing ferromagnetic alloy particles in U.S. Pat. No. 3,672,867. In accordance with this procedure, two reacting streams impinge forcibly and mix. Reaction takes place upon mixing. Optionally a solenoid or gap of a permanent magnet may be located at and immediately after the point of impingement, however, this latter procedure has been of questionable value.

SUMMARY OF THE INVENTION

Accordingly, an object of the present invention is to provide a process for producing conveniently and continuously a ferromagnetic powder which has excellent magnetic properties, which has excellent dispersibility in a binder, and which is chemically stable, and an apparatus for the process.

Another object of the present invention is to provide a process for producing conveniently and continuously a ferromagnetic powder which has high coercive force (Hc) and saturation magnetization (Bs), and which is excellent in squareness ratio, Br/Bs (wherein Br is the residual flux density and Bs is the saturated flux density), and an apparatus for the process.

These objects are attained by the process of this invention which comprises injecting an aqueous solution of a metal salt which is capable of forming a ferromagnetic substance and a solution containing a reducing material into a uniformly applied magnetic field from nozzles for each of the solutions, and mixing the solutions immediately as they impinge on one another in the form of sprays to cause a reaction between them. The mixing procedure used in the present invention must be distinguished from mixing reactants in laminar flow. Laminar flow is possible only on a laboratory scale. It is not practical from an industrial standpoint. In accordancd with the present invention, the metal salt capable of forming the ferromagnetic material and the reducing agent are continuously mixed and reacted without using a laminar flow. The invention is thereby readily used on an industrial scale.

This invention also provides an apparatus for producing a ferromagnetic powder which comprises a reaction vessel, at least one nozzle for injecting each of a solution of a metal salt and a solution containing a reducing material into the reaction vessel and a magnet for producing a magnetic field of about 50 Oe or more in the reaction vessel, the nozzles being opened to the magnetic field, and positioned so that the solution of the metal salt and the solution of the reducing material when injected are mixed.

As indicated above, in accordancd with the prior art, the entire reaction has been carried out in the presence of a magnetic field. The magnetic field is applied from the time the magnetic particles are formed, through the super paramagnetic state to a time after the particles are in the ferromagnetic state. A large magnetic is required when the magnetic field is applied over the entire process and the process is carried out continuously using a merging stream reactor. Consequently, it is difficult to practice the procedure in the presence of a magnetic field on an industrial scale.

The present invention is based on the discovery that a ferromagnetic particle having satisfactory magnetic properties can be obtained without applying the magnetic field from the time the particle is formed through the time the particle is in the ferromagnetic state. Satisfactory magnetic properties can be obtained by applying the magnetic field only from the time the particles are in the superparamagnetic state to the time they are in the ferromagnetic state. The present invention can be contrasted to conventional processes wherein the magnetic field is applied to the particles for a period of time well after the particles are in the ferromagnetic state in order to align the ferromagnetic dipoles of the particles, in accordance with the present invention the magnetic field is applied only over the period during which the particles become ferromagnetic particles after passing through the superparamagnetic state.

BRIEF DESCRIPTION OF THE DRAWINGS

The drawing is a schematic illustration of an embodiment of the present invention.

DETAILED DESCRIPTION OF THE INVENTION

In order to more completely clarify the present invention, an embodiment of the present invention will be explained in detail by reference to the accompanying drawing.

The accompanying drawing shows an embodiment of the apparatus for the production of a ferromagnetic metal powder according to the present invention.

Referring to the drawing, 11 is a cylindrical reaction vessel for effecting the reaction, 13 is a precipitate tank positioned below the reaction vessel 11, and 14 is a magnet for applying a magnetic field.

First, an aqueous solution of a metal salt which is capable of forming a ferromagnetic substance 21 (hereinafter referred to as "M liquid"), in a storage tank 19 (hereinafter referred to as "M liquid storage tank") is drawn up through a conduit 23 by a a pump 20 and pumped through a conduit 25 to a tank 18 in which the level of the M liquid is controlled (hereinafter referred to as "M liquid level controlling tank"). The M liquid level controlling tank 18 is provided with an overflow port **18*a* on the upper portion thereof, which always maintains the level of the liquid at a constant height. That is, an excessive amount of the M liquid 21 is pumped to the M liquid level controlling tank 18 and a portion of the M liquid overflows through the M liquid overflow port 18*a* to the M liquid storage tank 19. The M liquid 21 fed to the M liquid level controlling tank 18 is continuously injected through a conduit 17 into the cylindrical reaction vessel 11 at a constant liquid pressure by a nozzle 16**.

On the other hand, a solution containing a reducing material 21' (hereinafter referred to as "R liquid") in a storage tank 19' (hereinafter referred to as "R liquid storage tank") is drawn up through a conduit 23' by a pump 20' and pumped through a conduit 25' to a tank 18' in which the level of the R liquid is controlled (hereinafter referred to as "R liquid level controlling tank"). The R liquid level controlling tank 18' is provided with an overflow port **18*a*' on the upper portion thereof, which always maintains the level of the liquid at a constant height. That is, an excessive amount of the R liquid 21' is pumped to the R liquid level controlling tank 18' and a portion of the liquid overflows through the R liquid overflow port 18*a*' to the R liquid storage tank 19'. The R liquid 21' fed to the R liquid level controlling tank 18' is continuously injected through a conduit 17' into the cylindrical reaction vessel 11 at a constant liquid pressure by a nozzle 16'**.

The M liquid 21 and R liquid 21' injected into the cylindrical reaction vessel 11 are mixed at a point 22 of confluence and the reaction between them immediately occurs. The particles fall in a superparamagnetic state and flow down while reacting in a magnetic field applied by a magnetic field applying magnet 14 (hereinafter referred to as a "magnet") in the reaction vessel 11 and reach the precipitate tank 13.

In order to prevent the reaction vessel 11 from being filled with a large amount of hydrogen gas produced during the reaction, the reaction vessel is provided with an exhaust port 15 through which the hydrogen gas is withdrawn from the reaction vessel 11 and subjected to a suitable treatment. The reaction solution 12 which reaches the precipitate tank 13 is, if desired, introduced through a valve 26 provided at the lower portion of the precipitate tank 13, into a washing stage, and thus an end product ferromagnetic powder is obtained.

With regard to the magnetic field applied to the portion in the reaction vessel 11 where the reaction is conducted, it is required to be applied to such an extent that the magnetic field intensity is effective to provide a squareness ratio Br/Bs of about 0.70 or higher and a ratio $\Delta B/\Delta H$ of about 3.0 or more, i.e., a magnetic field intensity of about 50 Oe or more, e.g., up to about 10,000 Oe from a practical standpoint. Moreover, the application of the magnetic field must be conducted for the period during which the M and R liquids flow while reacting with each other and the particles produced by the reaction grow through the superparamagnetic state to a ferromagnetic particle. In the case of Example 1 given hereinafter, the period is about 50 milliseconds after the mixing of the M and R liquids, which corresponds to a flow distance of about 2 cm. However, the apparent induction period decreases as both solutions are mixed vigorously, and finally, the induction period becomes too short to determine an exact period. Accordingly, from a practical and operational standpoint, the mixing is preferably carried out in the magnetic field from the beginning of the mixing. With the application of the magnetic field, a ferromagnetic powder having excellent properties can be obtained. Where the strength of the magnetic field is below 50 Oe or the magnetic field is applied after the lapse of the above mentioned period, a ferromagnetic powder having excellent properties cannot be obtained.

The period of time during which the particles pass through the superparamagnetic state to the ferromagnetic state can be determined on a trial and error basis by carrying out the reaction under identical conditions and stop the reaction at various points in time. The magnetic characteristic of the particle may be observed using the Mössbauer effect. A detailed description of the Mössbauer effect is disclosed in H. Frauenfelder "The Mössbauer Effect" (W. A. Benjamin, New York 1962), G. K. Wertheim, "Mössbauer Effect: Principles and Applications" (Academic Press, New York, 1964), Japanese Patent Appl. (OPI) 71900/1976 etc. When the particles are in the superparamagnetic state the Mössbauer spectrum of the particles exhibits an absorption peak at a relative velocity of zero. When the particles are in the ferromagnetic state, on the other hand, no peak occurs at zero and six peaks are observed at other points in the spectrum. Consequently, the two magnetic states can be readily distinguished and the period of time during which the particles are in the superparamagnetic state and pass to the ferromagnetic state can be determined for a given set of reaction conditions.

The reaction rate of the oxidation-reduction and the growth rate of the particles produced in the present invention are quite influenced by the mixing ratio of the M liquid and the R liquid, the feed rate of the M liquid and the R liquid, the concentration of the M liquid and R liquid, the degree of freshness of the M liquid and particularly the R liquid which is easily decomposable, and so on. Hence, the application time of the magnetic field required varies depending upon the reaction conditions employed. A long application time requires a large sized magnet, but a plurality of small sized magnets can be used in parallel in place of a large size magnet. The temperature must be maintained at about 65° C. or less, e.g., about 0° C. to about 65° C., so that the particles produced are immediately oxidized and the magnetic properties are prevented from being deteriorated. Since the reaction rate varies, as stated above, depending upon the reaction conditions, the reaction is sometimes completed immediately after the mixing of the liquids, or the reaction is sometimes completed during the period while the liquids are falling down in the cylindrical reaction vessel 11, or the reaction is sometimes not completed even after the liquids reach the precipitate tank 13. However, where the reaction solution is continuously withdrawn from the precipitate tank 13, it is desired that the reaction be completed before the liquids reach the precipitate tank 13.

In order to conduct the reaction effectively, a plurality of nozzles for injecting the M liquid and nozzles for injecting the R liquid can be provided in the inner portion of the reaction vessel 11. Although the present invention is explained herein be reference to an embodiment wherein the M and R liquids are injected by a liquid pressure, the injection can be carried out by using a gas pressure of an inert gas such as nitrogen, helium and the like in place of the liquid pressure. In this case, the pressurization of the R liquid is quite effective in that the hydrogen gas liberated by the decomposition can be dissolved in the liquid.

The necessary application time of magnetic field is generally sufficient if 5 seconds or less and an application of magnetic field for 5 seconds or more is not economical. The actual period of application will vary depending on the reaction conditions.

The term "metal salts capable of forming a ferromagnetic substance" as used in the present invention designates those compounds which contain any one of Fe, Co, Ni, Fe—Co, Fe—Ni and Fe—Co—Ni, and, if desired, a suitable amount of one or more salts selected from salts of rare earth elements, e.g., La, Ce, Nd, Sm and the like, salts of metals Sn, Al, W, Cr, Mn, Cu, Zn, Ag, Pd, Mo and the like for improving the magnetic properties and the oxidation stability. Representative examples of these compounds are the sulfates, chlorides, sulfides, nitrates, formates, acetates, pyrophosphates, sulfomates and the like of the above described elements, e.g., iron sulfate, cobalt sulfate, nickel sulfate, iron chloride, cobalt chloride, nickel chloride, iron nitrate, cobalt nitrate, nickel nitrate, chromium chloride, chromic acid anhydride, chromium nitrate, chrome alum, manganese nitrate, copper sulfate, copper nitrate, lead acetate, zinc chloride, etc.

As the R liquid, water or polar organic solvents, e.g., alcohols such as methanol, ethanol, tetrahydrofurfurylalcohol, dimethylformamide, n-propylamine, isopropylamine, n-butylamine, ethylenediamine, dimethylsulfoxide, ethylene glycol dimethyl ether, triethylene glycol dimethyl ether, etc., and the like, containing borohydride compounds, e.g., sodium borohydride, potassium borohydride, borane, borazane, borohydride, diemthylaminoborane, diethylaminoborane and the like, or one or more derivatives thereof, or hypophosphites such as sodium hypophosphite, potassium hypophosphite, etc., hydrazine or derivatives thereof such as hydrazine, hydrazinium sulfate, hydrazinium hydrogensulfate, etc., can be used. The M liquid can contain, if desired, a complexing agent, a pH buffer agent, a pH controlling agent and the like in addition to the above described components. Suitable pH buffer agents and complexing agents include monocarboxylic acids, e.g., formic acid, acetic acid, propionic acid, butyric acid, valeric acid, acrylic acid, trimethylacetic acid, benzoic acid and the like, or the salts (e.g., sodium and potassium) thereof. Suitable complexing agents include dicarboxylic acids, e.g., oxalic acid, succinic acid, maloic acid, maleic acid, itaconic acid, p-phthalic acid and the like, or the salts (e.g., sodium and potassium) thereof, and oxycarboxylic acids, e.g., glycolic acid, lactic acid, salicylic acid, tartaric acid, citric acid and the like, or the salts (e.g., sodium and potassium) thereof. Examples of pH controlling agents and pH buffer agents are boric acid, carbonic acid, sulfurous acid and the like. Typical examples of pH controlling agents, other inorganic acids, organic acids, ammonia, alkali metal hydroxides such as sodium hydroxide, potassium hydroxide, etc., and the like can be used. The amount of the complexing agent employed can suitably range from about 5 wt% to 400 wt% to the metal ion, and the pH can suitably range from about 1 to 13 when sodium borohydride is employed, and about 7.5 to 13 when sodium hypophosphite is employed.

These additives not only can be employed for one function but also multiple functions. For instance, some compounds act as a complexing agent as well as a pH buffer agent, and thus the action of the additive is not limited.

It has been found that the metal ion concentrations contained in the M liquid of about 0.002 to 2 mole/liter and preferably 0.01 to 0.5 mole/liter bring about good results.

It is preferred that the concentration of the borohydride compound or derivative thereof ranges from about 0.0002 to 10 mole/liter, preferably 0.01 to 5 mole/liter. Preferred results can be obtained with a molar ratio of the reducing agent to the metal ion of about 0.02 to 10, preferably 0.1 to 5.

The ferromagnetic powder produced according to the method of the present invention contains about 0.1 to 10% by weight of boron. It has been observed that each ferromagnetic powder particle is granular and several or tens of several particles are combined, forming a chain of particles in a string, a rod or a necklace-like shape.

It has been observed that the distribution of the particle size and chain particle is narrow and there is a low amount of scattering.

The ferromagnetic powder as obtained by the method of the present invention has quite excellent properties of a coercive force Hc of about 10 to 2000 Oe and a saturation magnetization Bs of about 8,000 G or more.

The magnetic properties of the ferromagnetic powder produced by the method of the present invention can be improved by further heating the powder in a non-oxidizing atmosphere such as an atmosphere of helium, argon, nitrogen, carbon monoxide, carbon dioxide, hydrozen, etc., or in the presence of a small amount of $H_2O$ or $O_2$, e.g., 10 volume % or less of water vapor or oxygen.

The ferromagnetic powder as obtained by the method of the present invention is mixed and dispersed in a binder, and coated on a support as a magnetic coating composition to produce a final product.

Binders which can be used as a binder in the present invention are hitherto known thermoplastic resins and thermosetting resins, or mixtures thereof.

Suitable thermoplastic resins have softing temperatures of about 150° C. or less, average molecular weights of about 10,000 to 200,000, and a degree of polymerization of about 200 to 500. Specific examples include, for example, a vinyl chloride-vinyl acetate copolymer, a vinyl chloride-vinylidene chloride copolymer, a vinyl chloride-acrylonitrile copolymer, an acrylic acid ester-acrylonitrile copolymer, an acrylic acid ester-vinylidene chloride copolymer, an acrylic acid ester-styrene copolymer, a methacrylic acid ester-acrylonitrile copolymer, a methacrylic acid ester-vinylidene chloride copolymer, a methacrylic acid ester-styrene copolymer, a urethane elastomer, polyvinyl fluoride, a vinylidene chloridene chloride-acrylonitrile copolymer, a butadiene-acrylonitrile copolymer, a polyamide resin, polyvinyl butyral, a cellulose derivative, a styrene-butadiene copolymer, a polyester resin, a chlorovinyl ether-acrylic acid ester copolymer, an amino resin, various rubber based thermoplastic resins, or mixtures thereof.

Representative examples of these resins are described in Japanese Patent Publication Nos. 6877/1962, 12528/1964, 19282/1964, 5349/1965, 20907/1965, 9463/1966, 14059/1966, 16985/1966, 6428/1967, 11621/1967, 4623/1968, 15206/1968, 2889/1969, 17947/1969, 18232/1969, 14020/1970, 14500/1970, 18573/1972, 22063/1972, 22064/1972, 22068/1972, 22069/1972, 22070/1972, 27886/1972, U.S. Pat. Nos. 3,144,352, 3,419,420, 3,499,789, 3,713,887, etc.

The thermosetting resins have a molecular weight of about 200,000 or less as a coating liquid and, when heated after coating and drying, the molecular weight of the resins become infinity due to reactions such as condensation, addition, and the like. Of these resins, preferred resins are those resins which do not soften or melt until they are decomposed. Representative examples of these resins are a phenol resin, an epoxy resin, a polyurethane curing type resin, a urea resin, a melamine resin, an alkyd resin, a silicone resin, an acryl based reactive resin, an epoxy-polyamide resin, a nitrocellulose-melamine resin, a mixture of a high molecular weight polyester resin and an isocyanate prepolymer, a mixture of a methacrylic acid salt copolymer and a diisocyanate prepolymer, a mixture of a polyester polyol and a polyisocyanate, a urea-formaldehyde resin, a mixture of a low molecular weight glycol/high molecular weight diol/triphenylmethane triisocyanate, a polyamine resin, and mixtures thereof.

These resins are described in Japanese Patent Publication Nos. 8103/1964, 9779/1965, 7192/1966, 8016/1966, 1427/1966, 18179/1967, 12081/1968, 28023/1969, 14501/1970, 24902/1970, 13103/1971, 22065/1972, 22066/1972, 22067/1972, 22072/1972, 22073/1972, 28045/1972, 28048/1972, 28922/1972, U.S. Pat. Nos. 3,144,353, 3,320,090, 3,437,510, 3,597,273, 3,781,210, 3,781,211, etc.

It is preferred that the resin binder be added to the ferromagnetic powder in an amount of about 30 to 300 parts by weight, preferably 50 to 150 parts by weight per 300 parts by weight, of the ferromagnetic powder as the composition of the finally formed film. In this case, the dry thickness of the magnetic recording layer ranges from about 1 to 10μ.

The magnetic recording layer is formed by dissolving the composition as prepared above in an organic solvent and coating the thus prepared coating solution on a support. The thickness of the support is about 5 to 5μ, preferably about 10 to 40μ. Suitable supports are polyesters such as polyethylene terephthalate, polyolefins such as polypropyrene, cellulose derivatives such as cellulose triacetate, cellulose diacetate and the like, polycarbonates and the like. The above described magnetic recording composition can be coated on the support using air doctor coating, plate coating, air knife coating, squeeze coating, dip coating, reverse roll coating, transfer roll coating, gravure coating, kiss coating, cast coating, spray coating, and the like. Needless to say, other methods can be employed and detailed explanations are described in *Coating Kogaku (Coating Engineering),* pages 253 to 277, published by Asakura Shoten (Mar. 1, 1972).

Suitable organic solvents which can be used in the coating are ketone solvents, e.g., acetone, methyl ethyl ketone, methyl isobutyl ketone, cyclohexanone, and the like; alcohol solvents, e.g., methanol, ethanol, propanol, butanol, and the like; ester solvents, e.g., methyl acetate, ethyl acetate, butyl acetate, ethyl lactate, glycol acetate monoethyl ether, and the like; ether and glycol ether solvents, e.g., diethyl ether, glycol dimethyl ether, glycol monoethyl ether, dioxane, and the like; hydrocarbon solvents (aromatic hydrocarbons), e.g., benzene, toluene, xylene, and the like; chlorinated hydrocarbons, e.g., methylene chloride, ethylene chloride, carbon tetrachloride, chloroform, ethylenechlorohydrin, dichlorobenzene and the like; and the like.

The present invention will be described in detail by reference to the following examples. Unless otherwise indicated, all parts, percents ratios and the like are by weight.

EXAMPLE 1

An M liquid having the composition as indicated in Table 1 below was injected into a cylindrical reaction vessel of a diameter of 50 mm and a height of 2 m at a rate of 200 ml per minute, while an R liquid was injected into the cylidrical reaction vessel at a rate of 50 ml per minute. The liquids were continuously mixed in a direct current magnetic field of 50 Oe. They reacted vigorously and ferromagnetic particles were precipitated in about 50 milliseconds after the mixing. The time corresponding to a flow distance of the reaction liquid of about 2 cm. The M and R liquids were reacted at a temperature of 20° C., but the temperature was slightly increased due to the reaction. In this case, the application distance of the direct current magnetic field was 5 cm.

The thus obtained ferromagnetic powder was sufficiently washed and the water was replaced with acetone, and the ferromagnetic powder was dried in an air dryer at 60° C. This sample was designated P-1.

The composition containing the above prepared powder as indicated in Table 2, was charged to a ball mill and sufficiently mixed and dispersed to prepare a magnetic coating composition. The coating composition was coated on one side of a polyethylene terephthalate film having a thickness of 25 microns while applying a magnetic field so as to provide a dry thickness of 5 microns, and dried by heating. The thus obtained wide magnetic web was supercalendered and slit to a width of ½ inch, and thus a video tape was obtained. The surface of the thus obtained tape was satisfactory. This sample was designated T-1.

Table 1

| | | Quantity (mole/liter) |
|---|---|---|
| M Liquid | Ferrous Chloride | 0.36 |
| | Cobaltous Chloride | 0.04 |
| | Potassium Chromium Sulfate | 0.002 |

Table 1-continued

| | | Quantity (mole/liter) |
|---|---|---|
| R Liquid | $NaBH_4$ | 1.6 |

Water was used as the solvent for both the M liquid and the R liquid.

Table 2

| | Parts |
|---|---|
| Ferromagnetic Powder | 300 |
| Polyester Polyol | 40 |
| Polyisocyanate Compound | 20 |
| Nitrocellulose | 20 |
| Aluminum Oxide (Grain Size: 0.3 microns) | 5 |
| Lecithin | 3 |
| Methyl Ethyl Ketone | 450 |
| Methyl Isobutyl Ketone | 400 |

EXAMPLE 2

The procedure of Example 1 was repeated with the exception that the R liquid was an alcohol solution prepared using ethyl alcohol in place of the water. The reaction was slow as compared with that of Example 1, and thus ferromagnetic particles were produced in about 150 milliseconds after the M and R liquids were mixed. The time corresponded to a flow distance of about 6 cm.

The magnetic field in the area where the magnetic particles were produced was 50 Oe. The thus prepared particles were subjected to the same treatment as described in Example 1 and thus ferromagnetic particles were obtained. This sample was designated P-2. Furthermore, a tape was prepared in the same manner as described in Example 1. This sample was designated T-2.

EXAMPLE 3

The procedure of Example 1 was repeated with the exception that a direct current magnetic field of 500 Oe was applied at a distance of 30 cm. The powder and tape produced were designated P-3 and T-3, respectively.

COMPARISON EXAMPLE 1

The procedures of Examples 1 and 2 were repeated but the magnetic field was not applied in the period during which the ferromagnetic particles were produced after injecting and mixing. Thereafter, a direct current magnetic field of 500 Oe was applied during the period when the particles reached a flow distance of 30 cm. The comparative samples corresponding to Example 1 as modified were designated P-4 and T-4, respectively comparative samples corresponding to Example 2 as modified were designated P-5 and T-5, respectively.

The properties of the powders as obtained in the Examples and Comparison Examples are shown in Table 3.

Table 3

| Sample | Average Grain Size | Bs | Bs on Stroage at 60° C and 90% RH for 10 Days |
|---|---|---|---|
| | (Å) | (G) | (G) |
| P-1 | 250 | 12,000 | 11,200 |
| P-2 | 200 | 11,800 | 11,000 |
| P-3 | 250 | 12,000 | 11,300 |
| P-4 | 250 | 10,800 | 10,400 |
| P-5 | 200 | 11,000 | 10,400 |

The properties of the tapes as obtained in the Examples and the Comparison Examples are shown in Table 4.

Table 4

| Sample | Hc | Br/Bs | ΔB/ΔH* | Dispersibility |
|---|---|---|---|---|
| T-1 | 1000(Oe) | 0.81 | 5.1 | Good |
| T-2 | 800 | 0.80 | 4.8 | " |
| T-3 | 1000 | 0.84 | 5.5 | " |
| T-4 | 950 | 0.63 | 2.5 | Average |
| T-5 | 800 | 0.65 | 2.8 | Good |

*ΔB/ΔH indicates the slope in the vicinity of B=O of the hysteresis curve.

As is apparent from the results of the above Examples and Comparison Examples, the method of the present invention requires that the magnetic field be applied at least during the period while the particles grow and are present in a superparamagnetic state. When this requirement is not satisfied, it can be seen that the magnetic properties and dispersibility are poor and the ΔB/ΔH is small.

In accordance with the present invention, advantages including the following effects can be obtained.

(1) Ferromagnetic powders can be conveniently and continuously produced which have excellent magnetic properties, i.e., high coercive force Hc and saturation magnetization Bs, and excellent squareness ratio, Br/Bs. Particularly, ferromagnetic powders can be produced which have quite excellent magnetic properties, i.e., a coercive force, Hc, of about 10 to 200 Oe and a saturation magnetization, Bs, of about 8000 G or more.

(2) Ferromagnetic powders can be conveniently and continuously produced which have a high B/H and a sharp slope in the vicinity of B=0 (coercive force) of a hysteresis curve, and thus a tape can be produced which has excellent sensitivity, i.e., high output.

(3) Ferromagnetic powders can be produced which have a narrow grain size distribution, and thus the properties vary only to a slight extent.

EXAMPLE 4

The procedure of Example 1 was repeated with exception that a direct current magnetic field of 1000 Oe was applied at a distance of 5 cm. The streams reacted vigorously and the magnetic particles were precipitated in about 50 milliseconds after mixing. The ferromagnetic powder was washed, dried with acetone and dried in air. This sample was designated Sample A.

COMPARISON EXAMPLE 2

By way of comparison to Example 4 the same liquid compositions were mixed for 1 minute at a flow rate of 200 ml/min and 50 ml/min, respectively, in a tank of 500 ml capacity. A magnetic field of 1000 Oe was applied for 2 minutes from the bottom of the tank and the ferromagnetic material was recovered as in Example 4. This sample was designated sample B.

The properties of the powders obtained in Example 4 and the Comparative Example are shown in Table 5.

Table 5

| Sample | Average Diameter of Particles | Hc | Br/Bm | B/H |
|---|---|---|---|---|
| A | 360 Å | 1000 Oe | 0.84 | 5.1 |
| B | 360 Å | 1000 Oe | 0.84 | 5.5 |

As is apparent from the results in the foregoing Table, the present invention permits the production of ferromagnetic powders having magnetic properties comparable to those which have heretofore only been capable of production on an industrial scale by the use of batch techniques of the type described.

While the invention has been described in detail and with reference to specific embodiments thereof, it will be apparent to one skilled in the art that various changes and modifications can be made therein without departing from the spirit and scope thereof.

What is claimed is:

1. In a continuous process for the production of a ferromagnetic powder comprising injecting a stream of an aqueous solution of a material capable of forming a ferromagnetic material and a stream of a solution containing a reducing material capable of undergoing an oxidation-reduction reaction with said aqueous solution to produce a ferromagnetic powder into a vertical reaction vessel such that said streams mix and the oxidation-reduction reaction is initiated, and withdrawing hydrogen gas produced during said oxidation-reduction reaction through an exhaust port in the reactor; the improvement which comprises:

applying a magnetic field of at least 50 Oe to the mixed stream at and immediately below the point of confluence but only for the period during which particles are produced by said oxidation-reduction reaction and the particles grow through the superparmagnetic state to the ferromagnetic state and not longer.

2. The process according to claim 1, wherein the solution containing said reducing material is selected from the group consisting of aqueous solutions and polar organic solutions of a borohydride compound and a derivative thereof, a hypophosphite, hydrazine or a derivative thereof.

3. The process according to claim 1, wherein the reacting of the solutions is in the form of a vapor.

4. The process according to claim 1, wherein the reacting is at temperatures of about 65° C. or less.

5. The process according to claim 1, wherein the application of the magnetic field is only for a period of about 5 seconds or less from the time said streams mix.

* * * * *